US006281457B1

(12) United States Patent
Chang

(10) Patent No.: US 6,281,457 B1
(45) Date of Patent: Aug. 28, 2001

(54) POWER SWITCH APPARATUS OF UNIVERSAL SERIAL BUS DEVICE

(75) Inventor: Bor-Sen Chang, Taipei Hsien (TW)

(73) Assignee: Aten International Co., Ltd. (TW)

( * ) Notice: Subject to any disclaimer, the term of this patent is extended or adjusted under 35 U.S.C. 154(b) by 0 days.

(21) Appl. No.: 09/527,380

(22) Filed: Mar. 16, 2000

(51) Int. Cl.[7] ..... H01H 17/02
(52) U.S. Cl. ..... 200/547; 200/50.01
(58) Field of Search ..... 200/51.11, 50.02, 200/51 R, 50.1, 50.14, 551

(56) References Cited

U.S. PATENT DOCUMENTS 3,784,765 * 1/1974 Daly ..... 200/5 R
3,839,614 * 10/1974 Saganowski et al. ..... 200/321
4,886,946 * 12/1989 Franks, Jr. ..... 200/329
5,315,079 * 5/1994 Gierut ..... 200/16 D
6,084,192 * 7/2000 Honma ..... 200/547

* cited by examiner

*Primary Examiner*—Paula Bradley
*Assistant Examiner*—Nhung Nguyen

(57) ABSTRACT

A power switch apparatus of universal serial bus device for protecting the universal serial bus device from electrical interference between a bus power mode and external power mode comprises a slide switch and socket door. The slide switch encased in the universal serial bus device selects either the bus power mode or the external power mode to serve as a unique power resource of the universal serial bus device by turning a control rod of the slide switch. The socket door assembled on the universal serial bus device has a pair of flanges protruding from an inner side of the socket door. The flanges is set at two sides of the control rod to turn the control rod to select the slide switch between the bus power mode and the external power mode, thereby preventing the universal serial bus device from the electrical interference.

15 Claims, 6 Drawing Sheets

POWER SWITCH APPARATUS OF UNIVERSAL SERIAL BUS DEVICE

FIELD OF THE INVENTION

This invention relates to a power switch apparatus, and more specifically to a power switch apparatus of universal serial bus (USB) device.

BACKGROUND OF THE INVENTION

Universal serial bus (USB), a new I/O standard promoted by main computer industrials, has been widely accepted by computer market. Since the USB port unifies many traditional I/O ports, such as serial ports, parallel ports, and PS/2 ports, into a single specification, it simplifies the usage of I/O ports. According to the specification, the USB port includes four wires, in which two wires convey digital information from port to port. The other two wires of USB port transmit electric power to drive peripheral devices connected thereon. For expanding the number of peripheral devices communicating with USB ports, many USB hubs may couple together to a host root hub, namely a computer, to build up a Tier-Star connection.

Typically, the USB hub includes at least a USB port and a direct current (DC) socket. In bus power mode, the host root hub transmits electric power through the two power lines of the USB port to drive the USB hub. Similarly, the USB hub transmits electric power to drive peripheral devices connected with it. In the present USB specification, the two power lines of USB port only convey electric current in about 100 mA. For some low power-consuming devices, this electric current is sufficient. However, for some high power-consuming devices, this electric current would not be able to drive them. In the cases of high power-consuming devices, the USB hub must be operated in external power mode by importing electric power through the DC socket. Thus, by selectively employing the USB port and DC socket, the USB hub would always drives the peripheral devices connected thereon.

Although the USB hub receives electric power selectively from the USB port or DC socket, it exits a problem of electrical interference, which is due to using the USB port and DC socket at the same time. When the electrical interference happens, the USB hub has no schemes to distinguish the two power modes, so that some errors or even more serious damages may happen. Therefore, there is a huge need to prevent the USB hub from occurring the electrical interference.

SUMMARY OF THE INVENTION

The objective of this invention is to provide a power switch apparatus for preventing the electrical interference, which is due to the USB port and DC socket in use at the same time, from happening.

A power switch apparatus of USB device comprises a slide switch, cover, and socket door. The slide switch encased in the universal serial bus device selects the USB device to be operated in either the bus power mode or the external power mode by turning a control rod of the slide switch. The socket door movably fits in an inner face of the cover, which is mounted on the USB device. A knob extends from an outer side of the socket door passing through and being confined by a window of the cover. When the knob rests at a first extreme point of the window to expose the DC socket of the USB device, a flange protruding form an inner side of the socket door shifts the control rod of the slide switch to a first position that enables the DC socket and suspends the USB port. Otherwise, When the knob rests at a second extreme point of the window to shield the DC socket of the USB device, a flange protruding form an inner side of the socket door shifts the control rod of the slide switch to a second position that enables the USB port and suspends the DC socket. Therefore, by pushing the knob, the USB device is always operated in either the bus power mode or the external power mode. In other words, the power switch apparatus prevents the electrical interference, which is due to the USB port and DC socket in use at the same time, from happening.

DETAILED DESCRIPTION OF THE PREFERRED EMBODIMENT

This invention discloses a power switch apparatus for preventing a USB device, such as a USB hub and USB connector, from electrical interference, which is caused by using its USB port and DC socket at the same time. The power switch apparatus mainly includes a slide switch and socket door. The slide switch, assembled on the USB device, switches the USB device in operation under bus power mode or external power mode. The socket door moves to either a position of shielding the DC socket from being accessed or the other position of exposing the DC socket under external accesses. When the socket door shields the DC socket, a mechanism turns the slide switch to enable the USB port of and suspend the DC socket. Likewise, when the socket door exposes the DC socket, the mechanism turns the slide switch to suspend the USB port and enable the DC socket. For illustrating the invention clearly, several embodiments are described as the following paragraphs.

Figure 1:
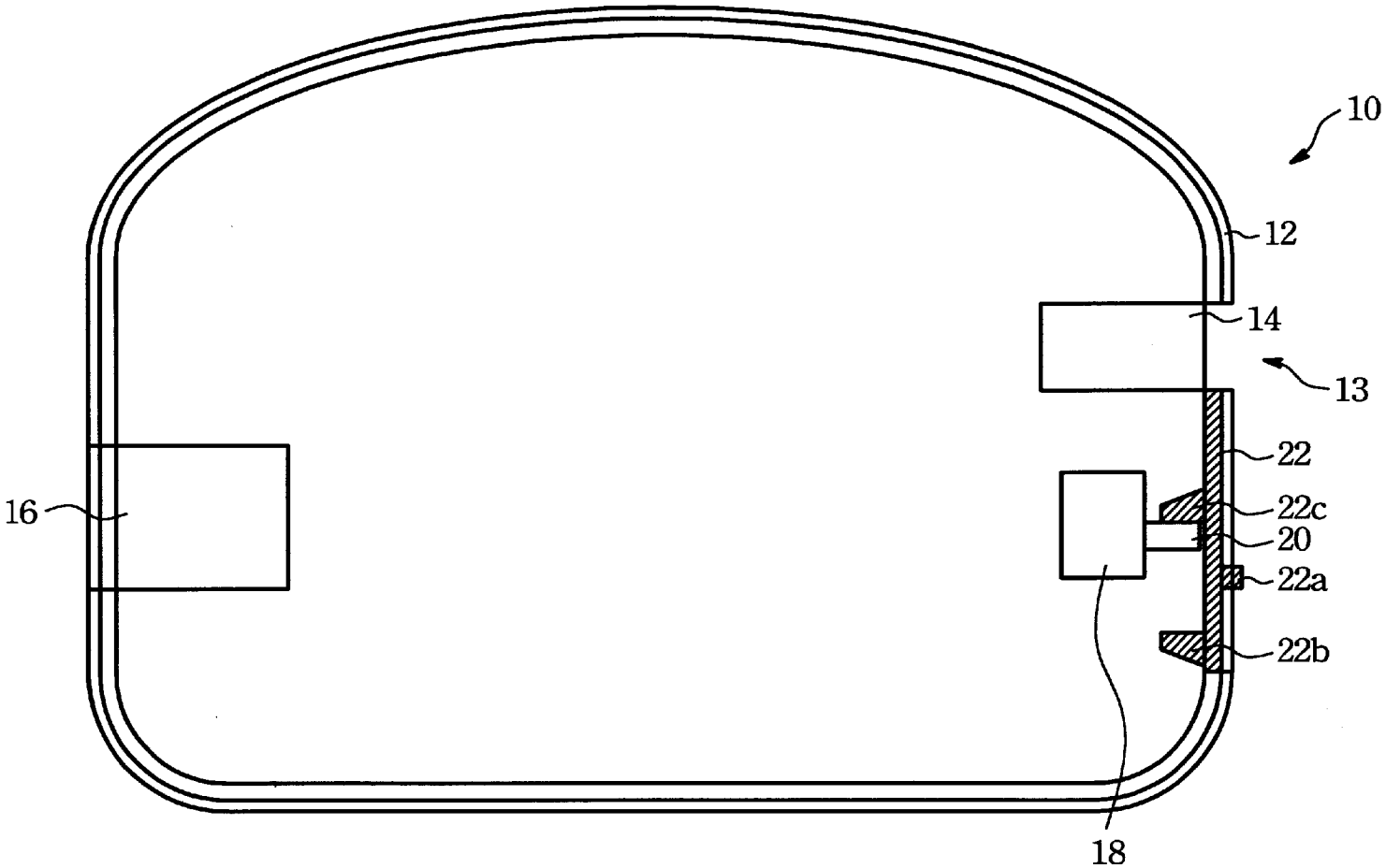
FIG. 1 is a top cross-sectional view of a USB device showing the present power switch apparatus exposing a DC socket.
Figure 2:
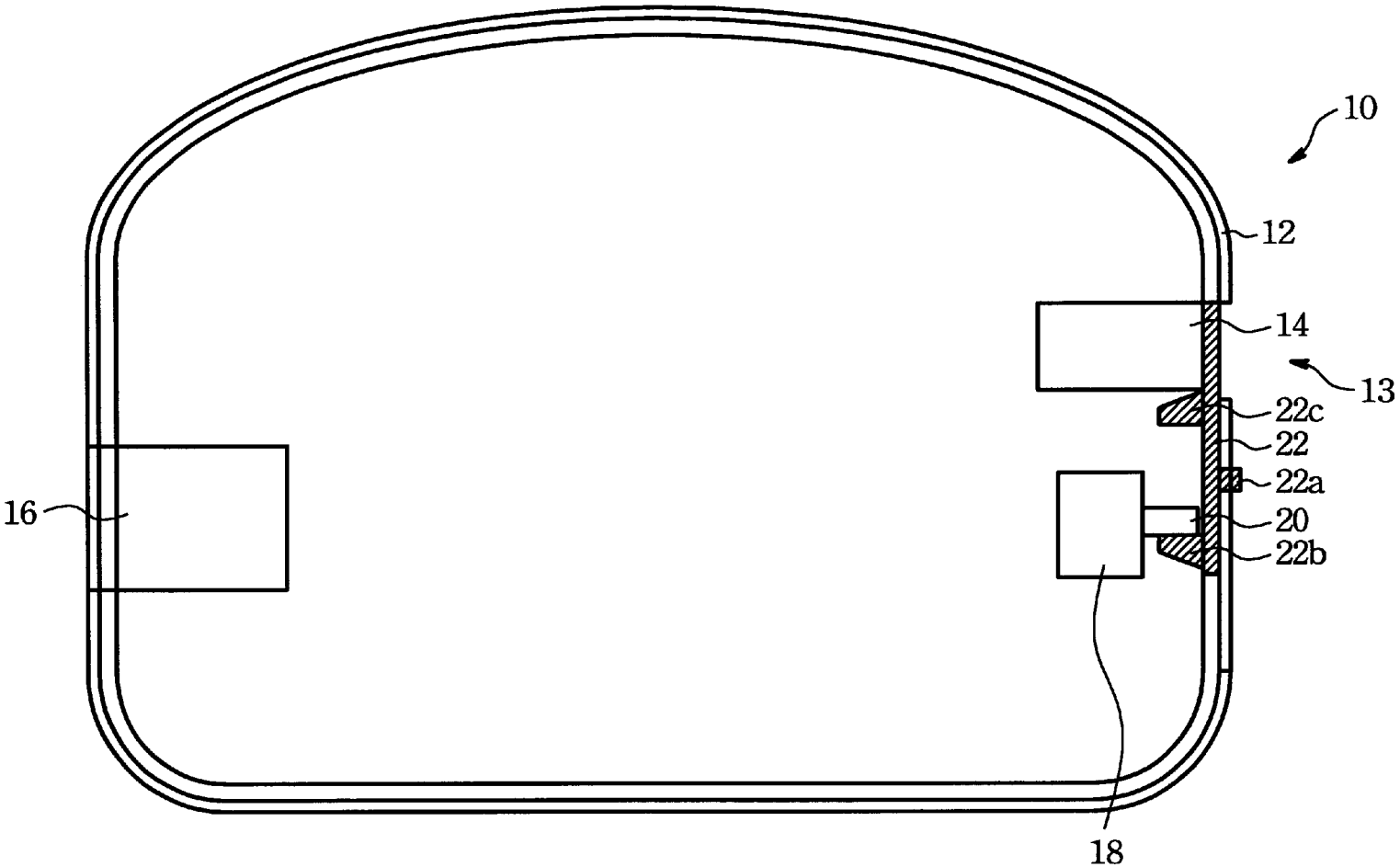
FIG. 2 is a top cross-sectional view of the USB device showing the resent power switch apparatus shielding the DC socket.

FIG. 1 shows a top cross-sectional view of a USB device 10, i.e. a USB hub or USB connector in the first embodiment of this invention. The USB device 10 has a USB port 16 and DC socket 14 for importing electric power in either bus power mode or external power mode. For preventing the electrical interference between the two power modes, i.e., bus power mode and external power mode, a power switch apparatus, mainly including a slide switch 18 and socket door 22, is employed to guarantee that the USB port 16 and DC socket 14 will never be operated at the same time. The slide switch 18 encased in the housing 12 is employed to set the USB device 10 in bus power mode or external power mode. When the control rod 20 of the slide switch 18 shifts to a first position (as shown in this figure), it enables the DC socket 14 for instance, by fitting with an adapter's plug and suspends the USB port 16. Likewise, when the control rod 20 shifts to a second position as shown in FIG. 2, the slide switch 18 enables the USB port 16 and suspends the DC socket 14. Therefore, no matter whether the control rod 20 shifts to the first position or the second position, the DC socket 14 and USB port 16 will never be operated at the same time. In other words, the USB device 10 will always in either bus power mode or external power mode, thereby avoiding the electric interference form happening.

The socket door 22 is assembled on the housing 12 of the USB device 10 for selectively shielding or exposing the DC socket 14. The socket door 22 has a knob 22*a* extending from its outer surface and two flanges 22*b*, 22*c* protruding from its inner surface. Pushing the knob 22*a*. rightward or leftward shifts the socket door 22 to shield or expose the DC socket 14. In external power mode, the socket door 22 rests at the first position to expose the DC socket 14 in order to access an external DC adapter plug (not shown). Moreover, in this case, the flange 22*c* pushes the control rod 20 also to the first position that enables the DC socket 16 and suspends the USB port 14. Turning to FIG. 2, when the socket door 22 shields the DC socket 14, the flange 22*b* pushes the control rod 20 to the second position that enables the USB port 16 and suspends the DC socket 14. Therefore, the present power switch apparatus provides a double protection against electric interference from shielding the DC socket 14 by the socket door 22 and suspending the DC socket 14 by the slide switch 18. It's noticed that the opening 13 in front of the DC socket 14 could be designed exactly fitting with the size of any standard adapters' plugs. In other words, the plug would fit into the DC socket 14, only if the socket door 22 entirely exposes from the opening 13. Such a design ensures the USB device 10 to be operated in the external power mode only when the control rod 20 is set at an exactly right position, namely the first position.

Figure 3A:
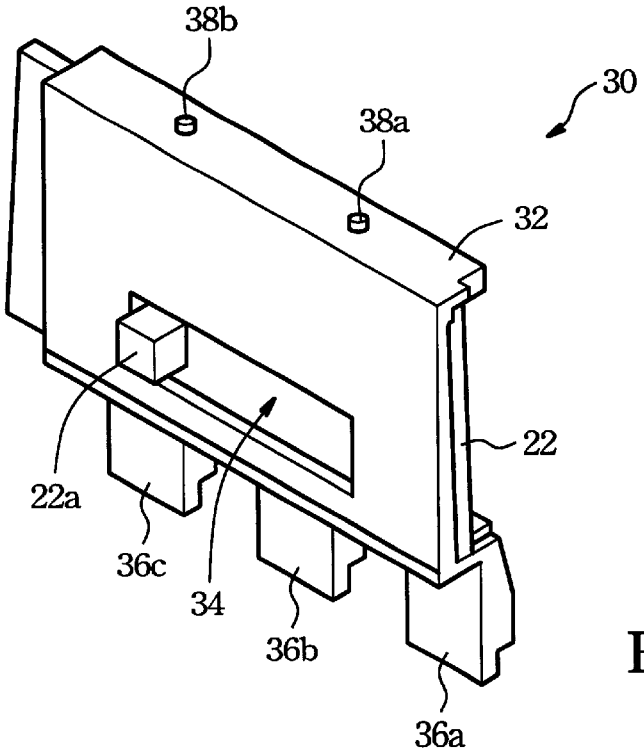
FIG. 3A is a three-dimensional view of a front side of a socket door assembly, when it rests at a first extreme point, in the first embodiment of this invention.
Figure 3B:
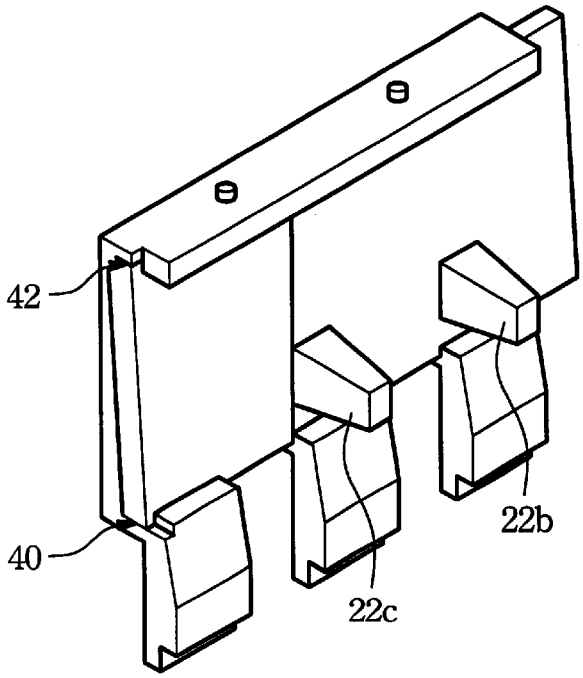
FIG. 3B is a three-dimensional view of a back side of the socket door assembly, when it rests at a first extreme point, in the first embodiment of this invention.

FIGS. 3A and 3B illustrates three-dimensional front and back views of a socket door assembly 30, which is employed to assemble the socket door 22 on the USB device (as shown in FIG. 1). The socket door assembly 30 mainly includes a cover 32 and socket door 22, which movably fits into a first groove 42 and second groove 40 of the cover 32. The know 22*a* of the socket door 22 extends through the window 34 of the cover 32. As a result of two extreme points of the window 34, namely its most right point and most left point, the know 22*a* is confined in a limited stroke motion between the most right left points. When the knob 22*a* rests at a first extreme point of the window 34, namely its most left point, the socket door 22 hides in the cover 32 to expose the DC socket (see FIG. 1) and the flanges 22*b*, 22*c* shift the control rod (see FIG. 1) in a manner illustrating above.

Still referring to FIG. 3A and FIG. 3B, there are two position heads 38*a*, 38*b* protruding from the top surface of the cover 32. By fitting the position heads 38*a*, 38*b* with position holes on USB device (not shown in this figure), the cover 32 can be assembled on the USB device in exact positions. Fixed members 36*a*, 36*b*, 36*c* extending form the bottom of the cover 34 not only provides groove 40 to guide the socket door 22, but also facilitates the cover 32 to be mounted on the USB device. In addition, because the fixed members 36*a*, 36*b*, 36*c* are made of any flexible materials, the socket door 22 can be easily fitted into the grooves 42, 40 by slightly bending the fixed members 36*a*, 36*b*, 36*c*. However, it's noticed that the fixed members 36*a*, 36*b*, 36*c* are not the only design of assembling the cover 32 on the USB device. Other equivalent connecting means, such as nails, screws, and tenon joints could also be employed to fix the cover 32 as alternatives.

Figure 4A:
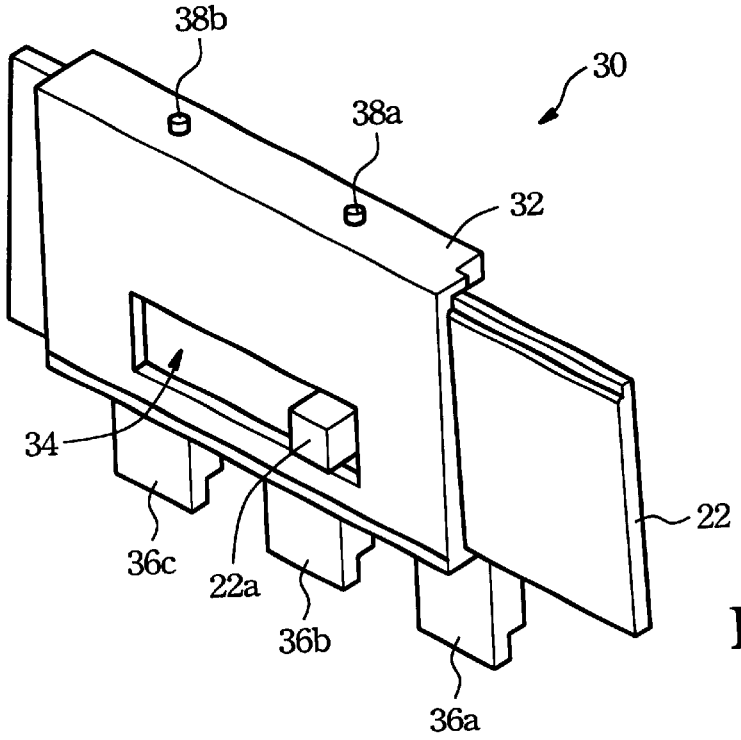
FIG. 4A is a three-dimensional view of a front side of the socket door assembly, when it rests at a second extreme point, in the first embodiment of this invention.
Figure 4B:
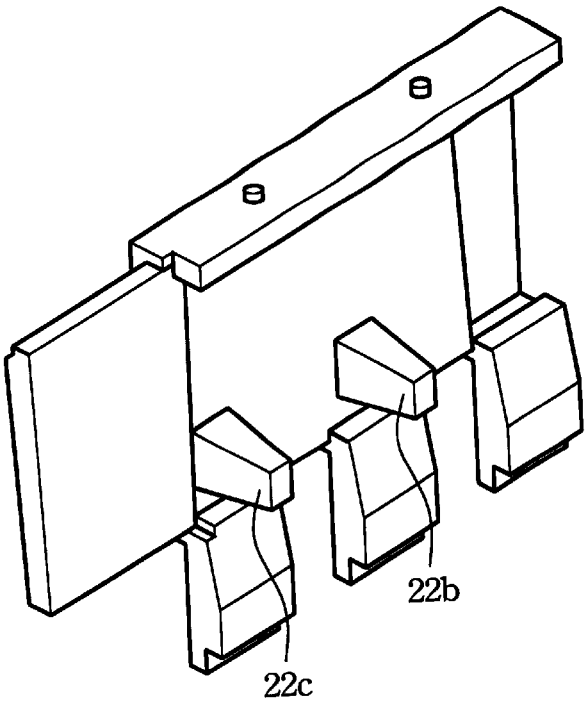
FIG. 4B is a three-dimensional view of a back side of the socket door assembly, when it rests at a second extreme point, in the first embodiment of this invention.
Figure 5A:
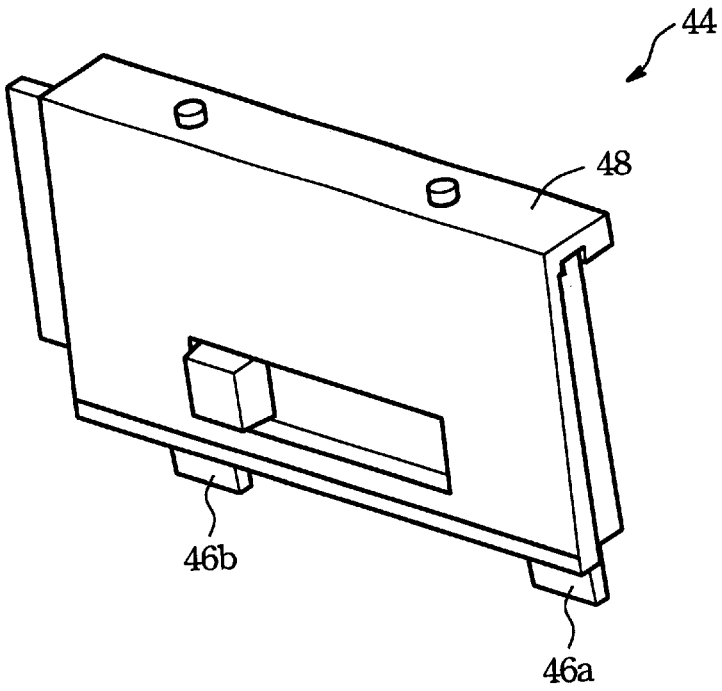
FIG. 5A is a three-dimensional view of a front side of a socket door assembly, when it rests at a first extreme point, in the second embodiment of this invention.
Figure 5B:
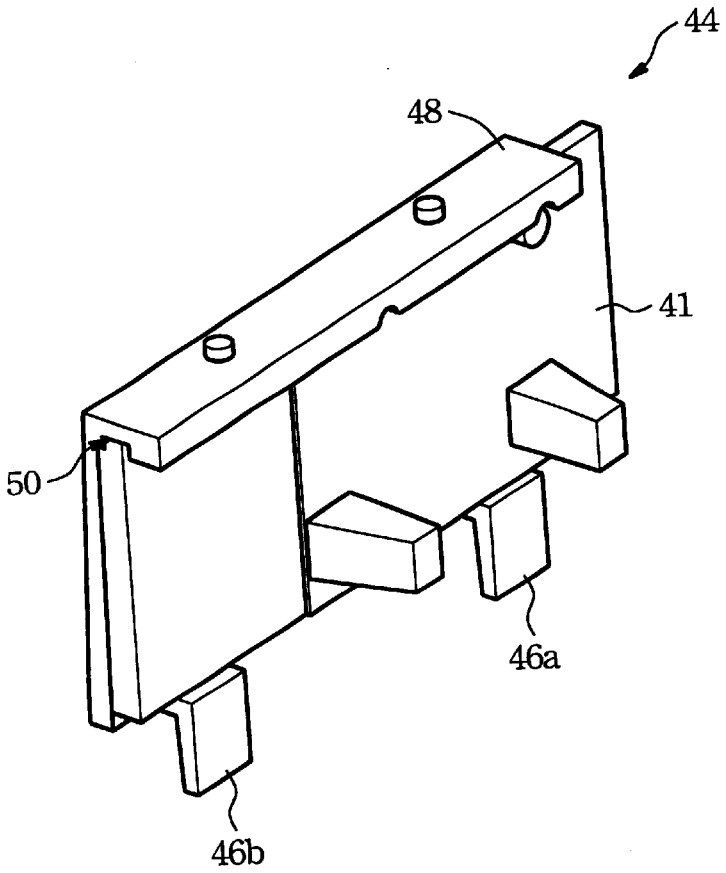
FIG. 5B is a three-dimensional view of a back side of the socket door assembly, when it rests at a first extreme point, in the second embodiment of this invention.
Figure 6A:
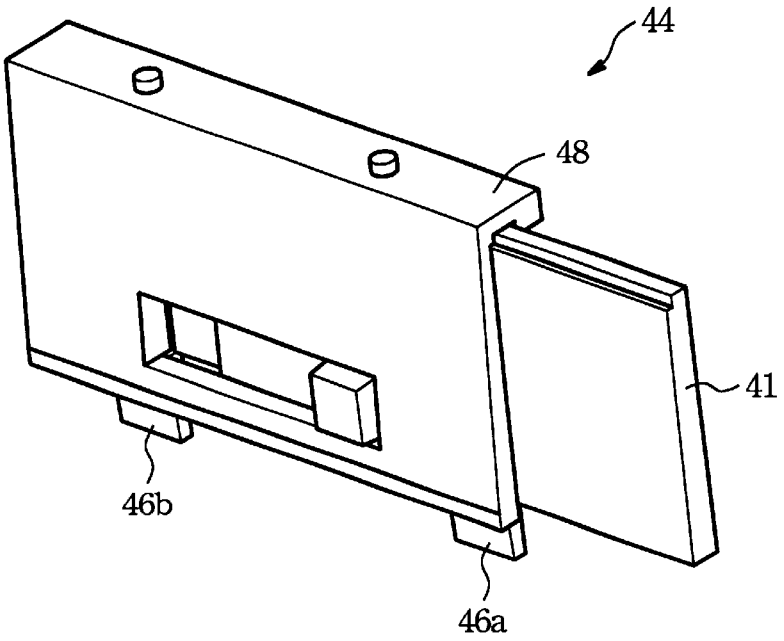
FIG. 6A is a three-dimensional view of a front side of the socket door assembly, when it rests at a second extreme point, in the second embodiment of this invention.
Figure 6B:
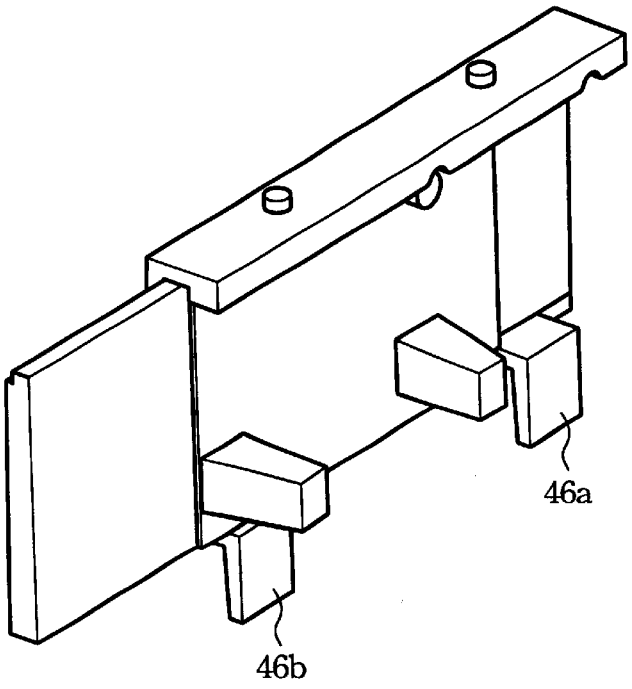
FIG. 6B is a three-dimensional view of a back side of the socket door assembly, when it rests at a second extreme point, in the second embodiment of this invention.

FIG. 4A and FIG. 4B show three-dimensional front and back views of the socket door assembly 30, in which the knob 22*a* rests at the second extreme point of the window 34. In this case, the socket door 22 extends out of the cover 32, thereby shielding the DC socket and shifting the control rod in a manner as illustrating above (see FIG. 2).

FIG. 5A, FIG. 5B, FIG. 6A, and FIG. 6B, show three-dimensional views of the socket door assembly 44 of the second embodiment. The main structure of the socket door assembly 44 is similar to that of the socket door assembly 30 (see FIG. 3A), and the way the socket door assembly 44 switches the control rod is also the same with the socket door assembly 30 does. Therefore, this paragraph focuses on the differences between the two embodiments, instead of describing the whole structure in detail. The differences of this embodiment are that the cover 48 only has two fixed members 46*a*, 46*b* with flat top surfaces, and there are no grooves on the fixed members 46*a*, 46*b*. In other words, socket door 41 only slides along the groove 50 of the cover 48. One of the advantages of such a design of the fixed members 46*a*, 46*b* is to make the assembly of the socket door 41 into the cover 48 easier, because assembling the socket door 41 needs not heavily bend the fixed members 46*a*, 46*b*, which may cause difficulties to assemble, if the fixed members 46*a*, 46*b* have grooves at their top surfaces. Moreover, when the socket door assembly 44 mounted on a USB device, it would provide restrictions to the socket door 41, thereby positioning the socket door 41 from deconstructing from the cover 48.

As is understood by a person skilled in the art, the foregoing preferred embodiments of the present invention that are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A power switch apparatus of universal serial bus device for protecting the universal serial bus device from electrical interference between a bus power mode of importing electric power via a universal serial bus port of the universal serial bus device and an external power mode of importing electric power via a direct current socket of the universal serial bus device, which comprises:

a slide switch encased in the universal serial bus device for selecting the universal serial bus device to be operated in either the bus power mode or the external power mode by shifting a control rod of the slide switch; and a socket door assembled on the universal serial bus device, at least a flange protruding from an inner side of the socket door into the universal serial bus for shifting the control rod at either a first position to enable the direct current socket and suspend the universal serial bus port or a second position to enable the universal serial bus port and suspend the direct current socket, and thereby prevent the electrical interference from happening.

2. The power switch apparatus of claim 1, wherein the socket door further comprises a knob protruding from an outer side of the socket door for leading the socket door moving rightward or leftward to drive the flange pushing the control rod rightward or leftward, thereby setting the universal serial bus device in either the bus power mode or the external power mode.

3. The power switch apparatus of claim 1, further comprising a cover mounted on the universal serial bus device for assembling the socket door on the universal serial bus service.

4. The power switch apparatus of claim 3, wherein the cover having a window for allowing the knob to project through and confining the knob moving in the window with a stroke motion.

5. The power switch apparatus of claim 4, when the knob rests at a first extreme point of the window along the stroke motion, the socket door shielding the direct current socket from being accessed by an adapter plug while enabling the universal serial bus port to receive the bus power mode by shifting the slide switch with the flanges.

6. The power switch apparatus of claim 4, when the knob rests at a second extreme point of the window along the stroke motion, the socket door opening to uncover the direct current socket, thereby allowing the direct current socket to be accessed by an adapter plug for enabling the universal serial bus device to receive the external power mode by turning the slide switch with the flanges.

7. The power switch apparatus of claim 3, further comprising a groove fitting with the socket door for guiding the socket door to move along the stroke motion.

8. The power switch apparatus of claim 3, further comprising a fixed member for assembling the cover on the universal serial bus device.

9. The power switch apparatus of claim 3, further comprising a position head for locating the cover relative to the universal serial bus device.

10. A power switch apparatus of universal serial bus device for protecting the universal serial bus device from electrical interference between a bus power mode of importing electric power via a universal serial bus port of the universal serial bus device and an external power mode of importing electric power via a direct current socket of the universal serial bus device, which comprises:

a slide switch encased in the universal serial bus device for selecting the universal serial bus device to be operated in either the bus power mode or the external power mode by shifting a control rod of the slide switch;

a cover having a window mounted on the universal serial bus device and;

a socket door movably fitting in an inner face of the cover for selectively shielding or exposing the cover by confining a knob protruding from an outer side of the socket door between a first extreme point and a second extreme point of the window, the socket door further having at least a flange for shifting the control rod by guidance of the knob at either a first position to enable the direct current socket and suspends the universal serial bus port or a second position to enable the universal serial bus port and suspends the direct current socket, thereby prevent the electrical interference from happening.

11. The power switch apparatus of claim 10, when the knob rests at the first extreme point of the window, the socket door shielding the direct current socket from being accessed by an adapter plug while enabling the universal serial bus port to receive the bus power mode by turning the slide switch with the flanges.

12. The power switch apparatus of claim 10, when the knob rests at the second extreme point of the window, the socket door opening to uncover the direct current socket, thereby allowing the direct current socket to be accessed by an adapter plug for enabling the universal serial bus device to receive the external power mode by shifting the slide switch with the flange.

13. The power switch apparatus of claim 10, further comprising a groove fitting with the socket door for guiding the socket door to move along a direction of the first extreme point and the second extreme point.

14. The power switch apparatus of claim 10, further comprising a fixed member for assembling the cover on the universal serial bus device.

15. The power switch apparatus of claim 10, further comprising a position head for locating cover relative to the universal serial bus device.

* * * * *